US006037532A

United States Patent [19]

Beckmeir

[11] Patent Number: 6,037,532

[45] Date of Patent: Mar. 14, 2000

[54] STRINGED MUSICAL INSTRUMENT WITH REMOVABLE FINGERBOARD

[76] Inventor: Fred Beckmeir, 1183 Aztec, Topanga, Calif. 90290

[21] Appl. No.: 09/161,246

[22] Filed: Sep. 25, 1998

Related U.S. Application Data

[60] Provisional application No. 60/089,776, Jun. 18, 1998.

[51] Int. Cl.[7] ..... G10D 3/00

[52] U.S. Cl. ..... 84/293; 84/314 R

[58] Field of Search ..... 84/293, 314 R

[56] References Cited

U.S. PATENT DOCUMENTS 4,132,143 1/1979 Stone ..... 84/314 R 4,137,813 2/1979 Stone et al. ..... 84/314 R

*Primary Examiner*—Jeffrey Donels

*Attorney, Agent, or Firm*—Robert J. Schaap

[57] ABSTRACT

A stringed musical instrument having an elongate neck and a body which may have a resonant cavity at one end and a head at the other end thereof. Strings extend across the neck and, when vibrated, generate musical sounds. The invention relies upon fingerboards which are removable so that a fingerboard can easily be repaired and replaced, or otherwise so that one fingerboard may be substitutable for another type of fingerboard in order to generate sounds of different timber or of different qualities. In a preferred embodiment, fretted fingerboards are substitutable for non-fretted fingerboards. Moreover, and in a preferred embodiment, the fingerboards are slid into and out of slots having beveled edges in the neck of the instrument. By using double beveled slots, that is, a first bevel relative to the thickness of the fingerboard, and a second bevel relative to the transverse dimension of the fingerboard, the fingerboard can be slid into a slot from one side of the neck and will precisely lie in proper marginal registration on that neck. Other types of attachment mechanisms for holding the fingerboard on the neck are also provided. Depending upon the material of construction of the musical instrument, and which is usually wood, the neck may be reinforced by a reinforcing member extending through the neck and into the head and the body.

37 Claims, 6 Drawing Sheets

STRINGED MUSICAL INSTRUMENT WITH REMOVABLE FINGERBOARD

RELATED APPLICATION

This application is a continuation of and based on my U.S. provisional patent application Ser. No. 60/089,776, filed Jun. 18, 1998, and entitled "STRINGED MUSICAL INSTRUMENT NECK WITH CHANGEABLE Fingerboard AND "T" SHAPED TRUSS".

BACKGROUND OF THE INVENTION

1. Field of the Invention

This invention relates in general to certain new and useful improvements in stringed musical instruments and, more particularly, to stringed musical instruments of the type having an elongate neck and a body and which are capable of generating electrical sounds in response to vibration of strings extending across that body and with removable fingerboards on the neck.

2. Brief Description of the Related Art

Most stringed musical instruments usually include an elongate neck with a body having a resonant cavity at one end and a head at the other end of the neck. Strings extend across the body of the musical instrument and, when vibrated, either by a bow or fingers or the like, the body will generate musical sounds. Instruments of this type usually include guitars, bases, violins, cellos and the like.

Many musical instruments are based on the generation of the sound through the instrument itself. Thus, in the case of a conventional guitar, the actual vibration of the string, which is usually in the form of a thin wire, with respect to a resonant cavity causes a generation of the desired sound. However, many of these instruments are electrified and use one of more transducers to generate the desire sounds in response to vibration of the strings.

In several of these musical instruments, each of the wires, referred to as "strings", are stretched under tension between the resonant body and the head. Further, in most of these instruments, the strings are stretched between a pair of projections in proximity to the neck, typically referred to as the "bridge" and the "neck". These two elements define the useful length of the strings and, hence, the sounds which are generated by those strings. Thus, by shortening the length between a point where the string engages the fingerboard to the bridge, the sound can be altered.

The aforesaid musical instruments are effectively divided into two major types of instruments in which the useful or active length of the string is adjusted by pressing the string against a fingerboard on the upper surface of the neck. In generally all cases, the fingerboard is an integral part of the neck of the musical instrument, or otherwise it is permanently affixed to the neck. However, some musical instruments are provided with frets on the fingerboard and are typically referred to as "fretted" musical instruments which allows the user to engage the string of the instrument against a-fret so that a useful length is achieved equal to the distance between the fret and the bridge. This will create a note of precisely defined timber and also of metallic character. Other instruments without frets are often referred to as "fretless" instruments and the useful length of the string is determined by the distance between the point at which the player keeps the string pressed against the fingerboard and the bridge. In absence of the fret, there is a lack of metallic quality to the sound and the sound also has a softer character.

It may be appreciated that for certain musical pieces, fretted instruments are desired and for other musical pieces, fretless instruments are desired. However, since there is no convenient means for altering an instrument with frets, or without frets, the average musician must constantly carry at least two such instruments, one containing frets and one without frets. In particular, for the base guitar and the slide or so-called "bottle neck" six-string guitar, each player almost inevitably carries at least two musical instruments for this purpose. However, this limits the player in attaining the desired musical flexibility while retaining the feel and capabilities of a preferred instrument.

There have been several attempts in the prior art to provide stringed musical instruments in which frets can be used or withdrawn. In U.S. Pat. No. 4,267,936 to Mouton, there is provided a stringed musical instrument having retractable frets. In this case, an electric base guitar is provided with retractable frets, such that in one position, the frets are flush with the surface of the fingerboard and, in another position, the frets are raised above the surface of the fingerboard. The neck of the instrument has an inclined slope on one side causing wedge shaped feet on the frets to ride on this inclined slope for raising and lowering the frets.

There is a also a proposed stringed musical instrument having retractable frets described in U.S. Pat. No. 4,772,260 to Pigozzi. In this case, a guitar has a fingerboard in which the frets are slidably disposed within the neck holding the fingerboard. A rather complex mechanism, including cams, springs and a rotatable shaft, are provided for raising and lowering the frets. While this type of instrument may be attractive in theory, as a matter of practicality, the mechanism used is quite complex and significantly adds to the overall weight, and certainly to the cost of the musical instrument.

In each of the aforesaid prior art systems for providing frets and effectively removing frets, they would be inherently slow and cumbersome. Consequently, these systems are not effective for the average musician who desires to quickly change from a fretted instrument to a fretless instrument. As a result, systems of the types proposed in these patents have not been effectively used.

OBJECTS OF THE INVENTION

It is, therefore, one of the primary objects of the present invention to provide a stringed musical instrument of the type having an elongate neck with a removable fingerboard and which fingerboard is rapidly and easily removed and replaced.

It is another object of the present invention to provide a stringed musical instrument of the type stated in which one fingerboard, such as a fretted fingerboard, can be substituted for another type of fingerboard, such as a fretless fingerboard.

It is a further object of the present invention to provide a stringed musical instrument of the type stated in which a fingerboard can be rapidly removed from the neck of a musical instrument and inserted back onto the neck of a musical instrument by slidably shifting the fingerboard into grooves formed in the neck of the musical instrument.

It is also an object of the present invention to provide a stringed musical instrument of the type stated in which fingerboards can be rapidly replaced for one another and which does not require re-tuning or adjustment of the musical instrument.

It is an additional object of the present invention to provide a stringed musical instrument of the type stated in which the neck of the musical instrument can be reinforced with a reinforcing member extending through that neck.

It is a salient object of the present invention to provide a stringed musical instrument of the type stated which is highly efficient in operation and does not deter a musician from use of the musical instrument in a variety of musical settings.

It is another salient object of the present invention to provide a stringed musical instrument of the type stated which can be constructed at a relatively low cost and which is still highly reliable in operation.

It is still a further object of the present invention to provide a method of converting a stringed musical instrument from a fretted musical instrument to an unfretted musical instrument.

With the above and other objects in view, my invention resides in the novel features of form, arrangement and combination of parts and components presently described and pointed out in the claims.

BRIEF SUMMARY OF THE INVENTION

The present invention relates in general to stringed musical instruments of the type which have an elongate neck and a body with a resonant cavity at one end of the neck and a head at the other end of the neck. Strings are stretched across the neck and over the resonant cavity body. Vibration of the strings results in the generation of musical sounds. This holds true for both the non-electric type musical instrument, as well as electrical musical instruments. The latter type of instrument is fitted with transducers to enable the generation of musical sound.

In the illustrated embodiment of the invention, as hereinafter set forth, an electric base guitar is illustrated. Moreover, this instrument is provided, in normal construction, with four strings. However, any stringed musical instrument, e.g., five string, six string musical instruments, etc., can also be used in accordance with the present invention.

In all embodiments of the invention, a fingerboard is provided on the neck of the musical instrument. This invention relates in a broad aspect to a means for removing a fingerboard on the neck.

Preferably, although not necessarily, the means for removing the fingerboard and repositioning a fingerboard does not require manually manipulating mechanical fasteners and again the remounting of the fingerboard on the neck, again preferably does not require manually manipulating mechanical fasteners.

More specifically, the invention also relates to the substitution of one type of fingerboard for another type of fingerboard. Thus, a musical instrument can be fitted with a fretted fingerboard and the fingerboard can be removed and a non-fretted fingerboard can be remounted on the neck of the musical instrument. It is important in connection with the present invention that the removal of one fingerboard and the remounting of another fingerboard be accomplished very quickly and with minimal amount of manual manipulation. In this way, a musician can readily change from a fretted musical instrument to an non-fretted musical instrument using essentially the same musical instrument, but with different fingerboards.

The present invention provides several means for releasably mounting the fingerboard to the neck of the musical instrument. In one embodiment, the fingerboard is secured to the neck by removable mechanical fasteners, such as screws. In this case, the heads of the screws would be counter-sunk into the fingerboard so that they do not protrude above the surface of the fingerboard. Another embodiment of the invention uses, for example, magnets mounted within the fingerboard and within the upper surface of the neck of the musical instrument. Thus, the fingerboard is magnetically coupled to the neck of the musical instrument.

In all embodiments of the invention, a slot or elongate groove is formed in the neck and, hence, the neck is of reduced thickness in the area where the fingerboard is normally located. The fingerboard is thus inserted in this elongate groove. In a more preferred embodiment, the groove is formed with beveled edges and the fingerboard is similarly formed with correspondingly beveled edges. Thus, the fingerboard slides into the elongate groove from one side of the neck toward the opposite longitudinal side of the neck.

By using double beveled grooves, the fingerboard will slide from one longitudinal side of the neck toward the opposite longitudinal side. If the bevels are properly sized, the fingerboard will stop so that it is in a desired marginal position with respect to the edges of the neck of the musical instrument. For this purpose, the transverse edges of the groove, that is, edges extending laterally across the neck, are beveled with an undercut. In this way, the edges of the fingerboard, which are tapered edges, will fit into the undercut edges of the groove. Moreover, the bevel is angularly located with respect to the transverse dimension of the fingerboard. Accordingly, a double bevel is provided and the fingerboard will be shifted to a proper marginal position within the neck of the musical instrument.

Due to the fact that the neck of the musical instrument has a reduced cross-sectional thickness as a result of forming a removable fingerboard, it may be desirable to reinforce the neck of the musical instrument to prevent bending moment forces from potentially cracking the neck or breaking the neck, particularly at the region of joinder to the head or the body. For this purpose, a reinforcing truss may be inserted through the neck and the head and body. The reinforcing truss does not necessarily protrude to the full opposite ends of the instrument, although in some cases, the reinforcing truss, which is in the nature of a fairly rigid truss, extends from the outer end of the head to the outer end of the body and through the neck of the instrument. Further, the reinforcing truss may be in the form of an I-beam or a T-beam type structural member.

It is also possible to form the neck of the musical instrument of laminated layers as, for example, layers of plastic and wood so as to provide increased strength. Further, the neck of the musical instrument could also be formed of reinforced plastic composite materials, such as boron with epoxy resins or carbon fibers with epoxy resins, and the like. Reinforcement could also be provided by other forms of reinforced plastics as, for example, other metals and fibers along with thermoplastic or thermosetting resins.

The present invention also provides for a locking rod or "retaining rod" which can be inserted through both the fingerboard and the head and body of the musical instrument. In this way, the fingerboard could be retained in a fixed position, if required. However, the locking rod is usually not required with the other means of releasably mounting the fingerboard to the neck, as described herein.

The present invention thereby fulfills the above and other objects and advantages in the provision of both an improved musical instrument and a method for modifying the musical instrument to provide for removable fingerboards. The improved musical instrument and the method of the invention is further exemplified by the following details description and the accompanying drawings. However, it is to be understood that this following detailed description and the accompanying drawings are set forth only for purposes of illustrating the general principles of the invention. Therefore, this following detailed description and the accompanying drawings are not to be taken in a limiting sense.

BRIEF DESCRIPTION OF THE DRAWINGS

Figure 1:
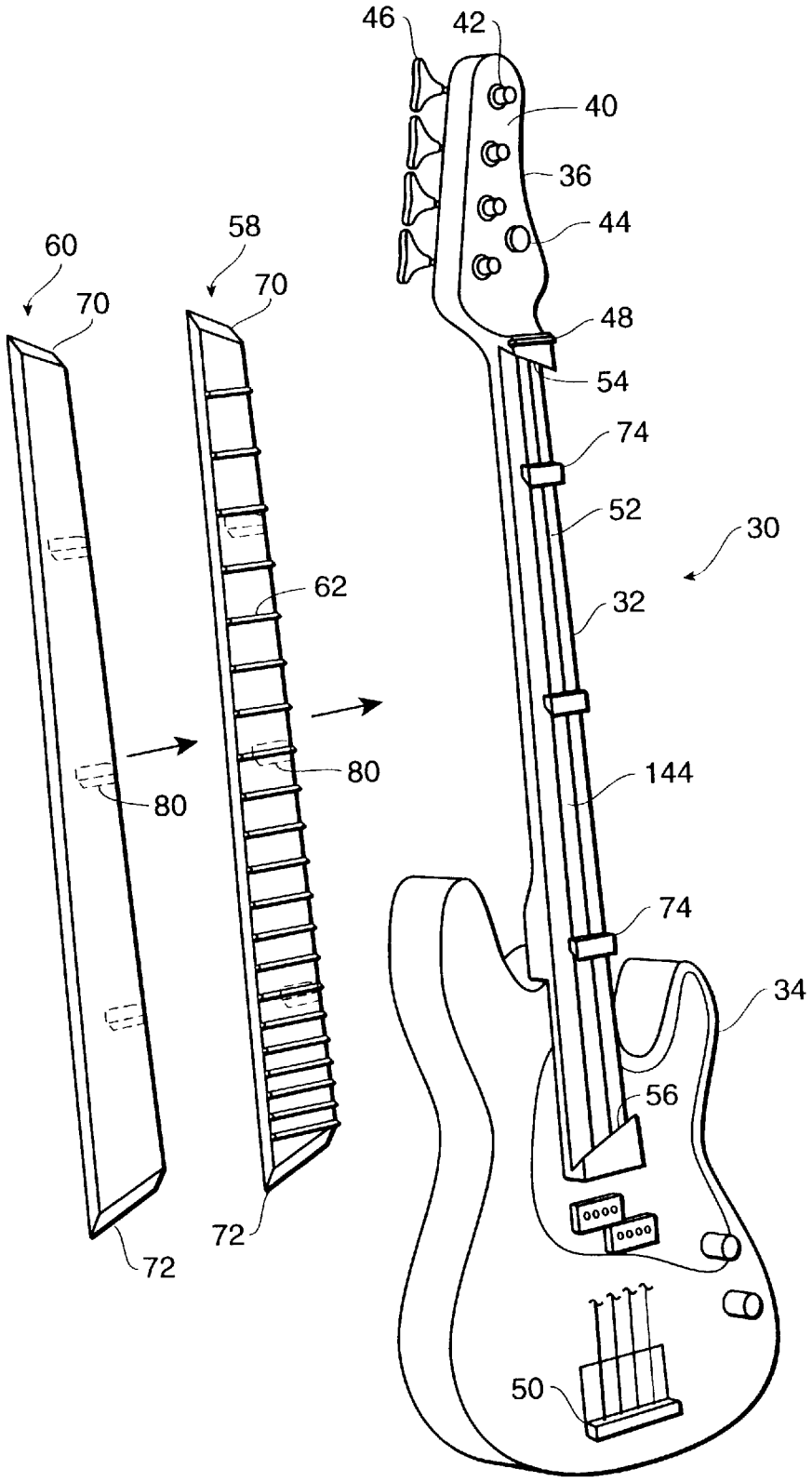
Figure 2:
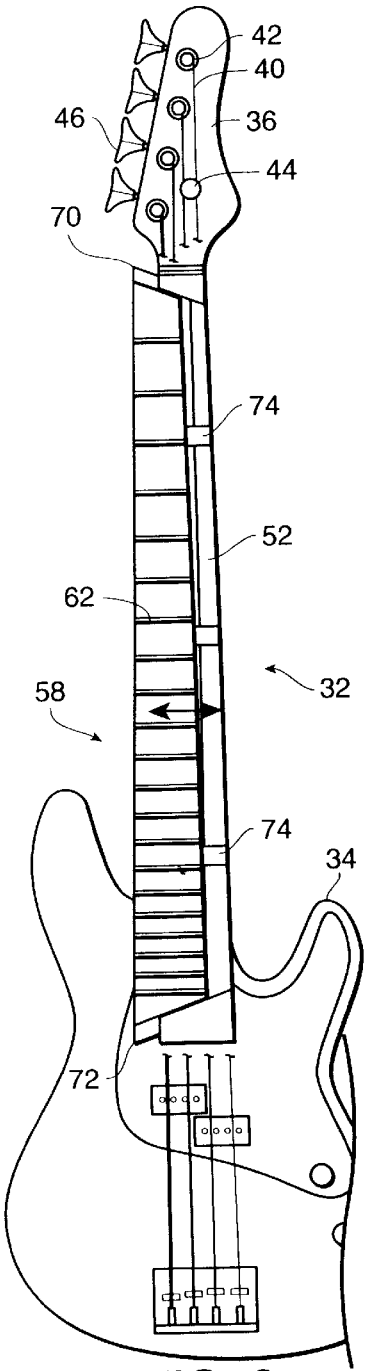
Figure 3:
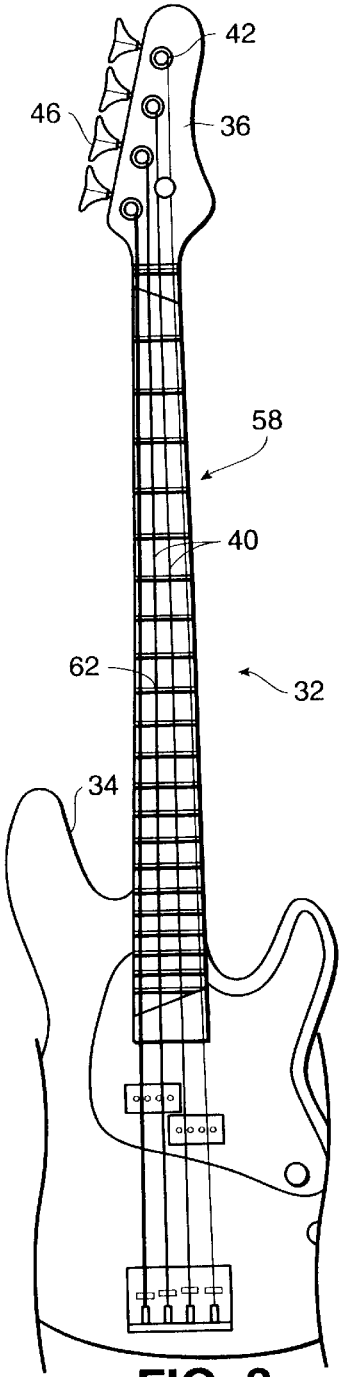
Figure 4:
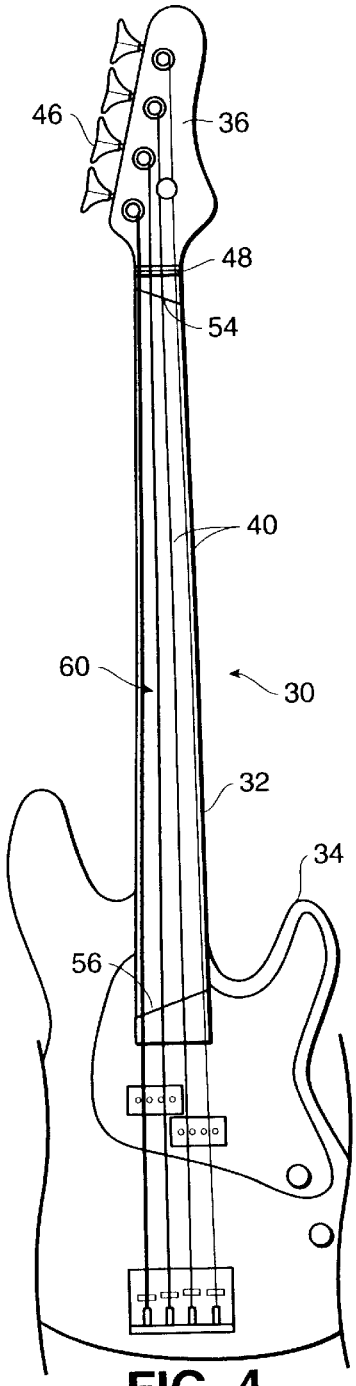
Figure 5:
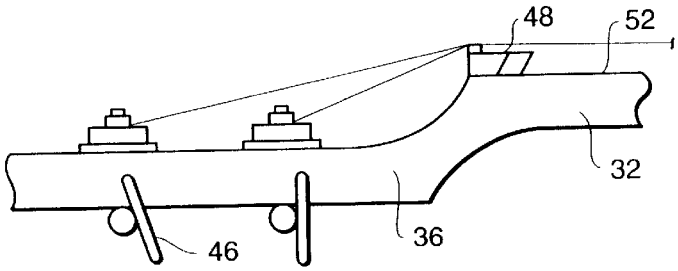
Figure 7:
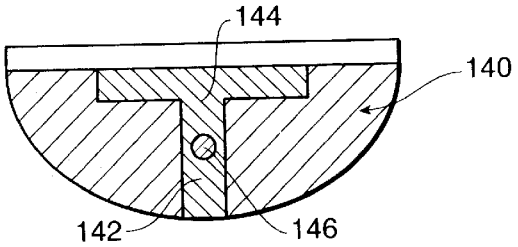
Figure 6:
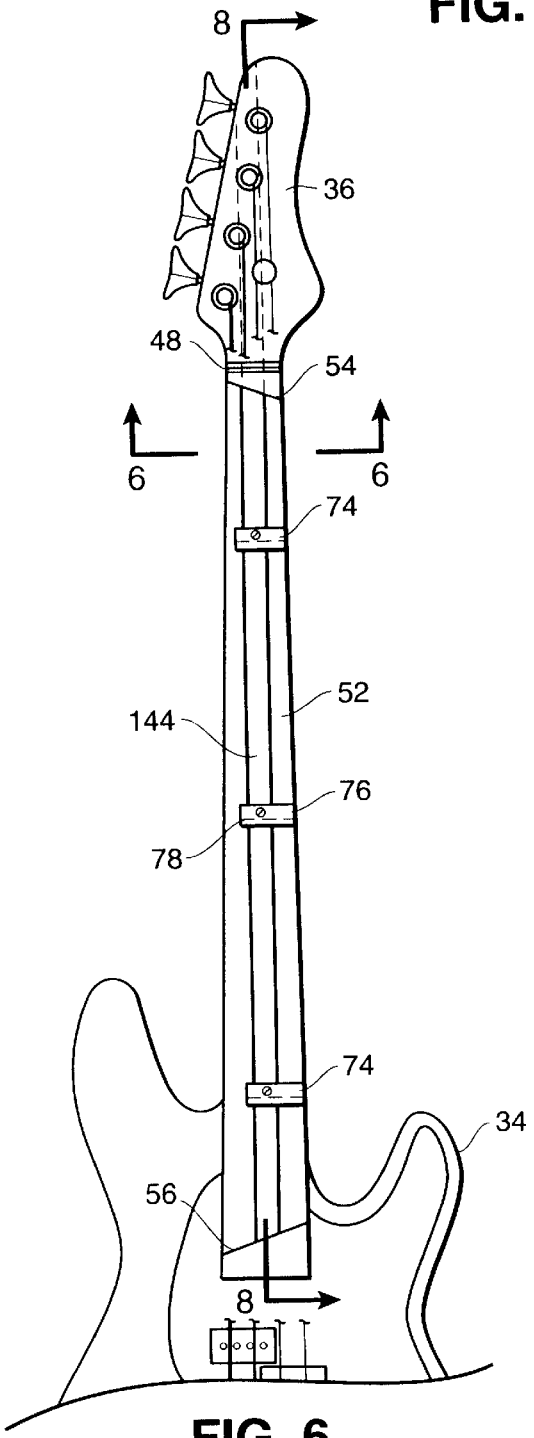
Figure 8:
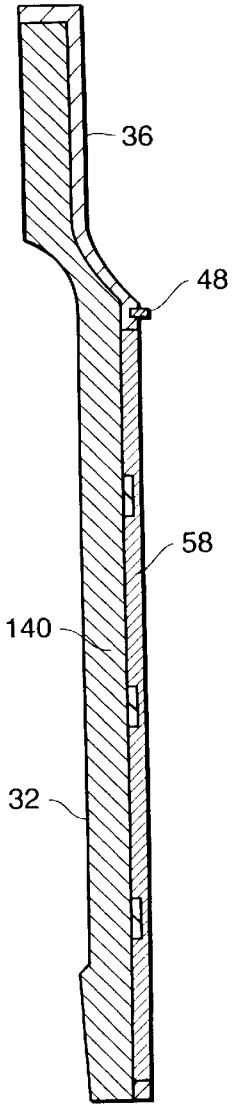
Figure 9:
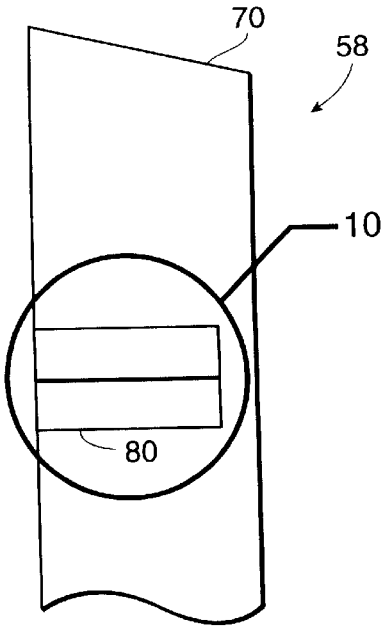
Figure 10:
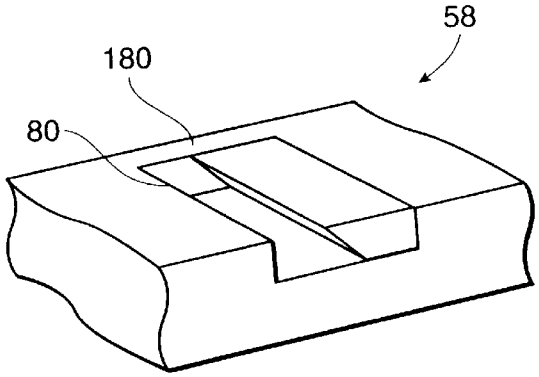
Figure 11:
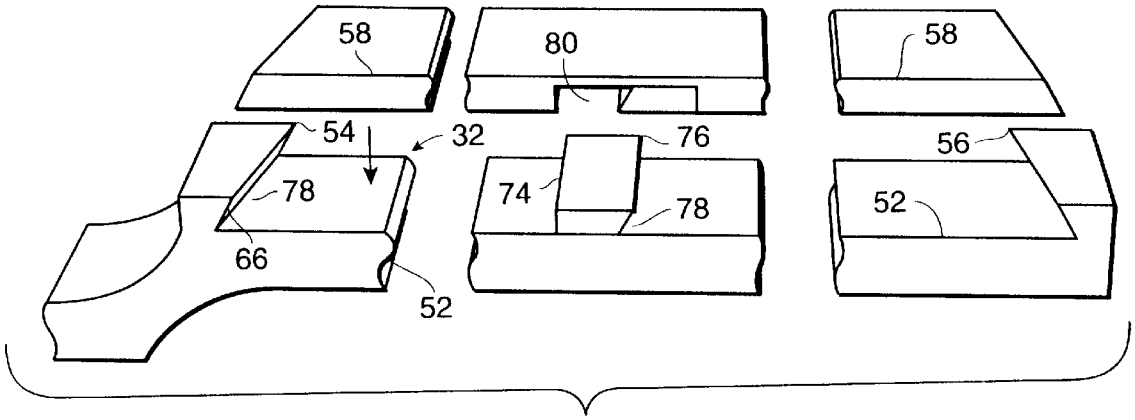
Figure 12:
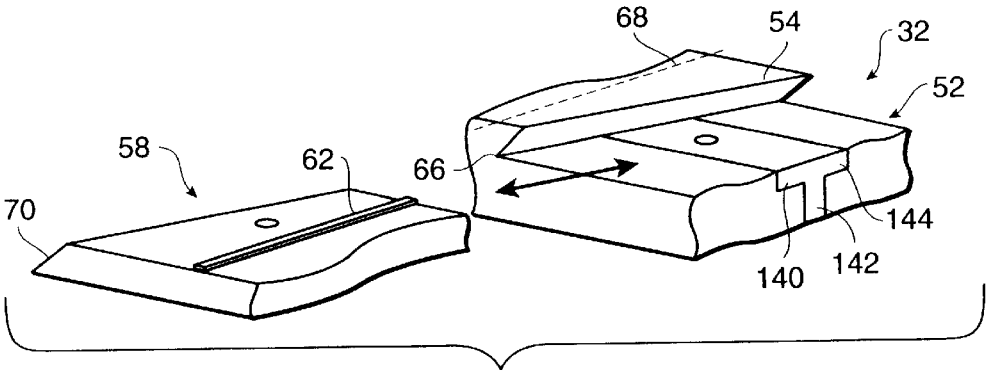
Figure 13:
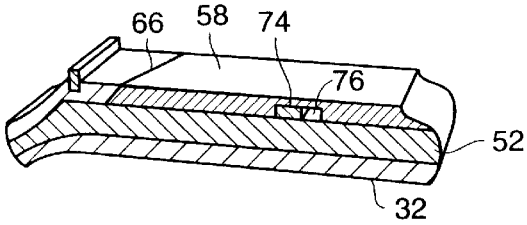
Figure 14:
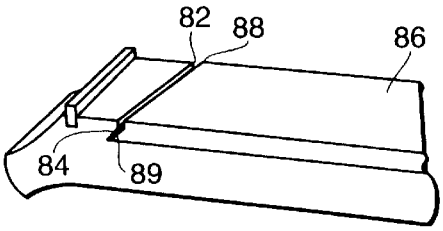
Figure 15:
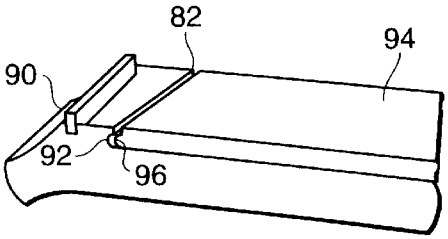
Figure 16:
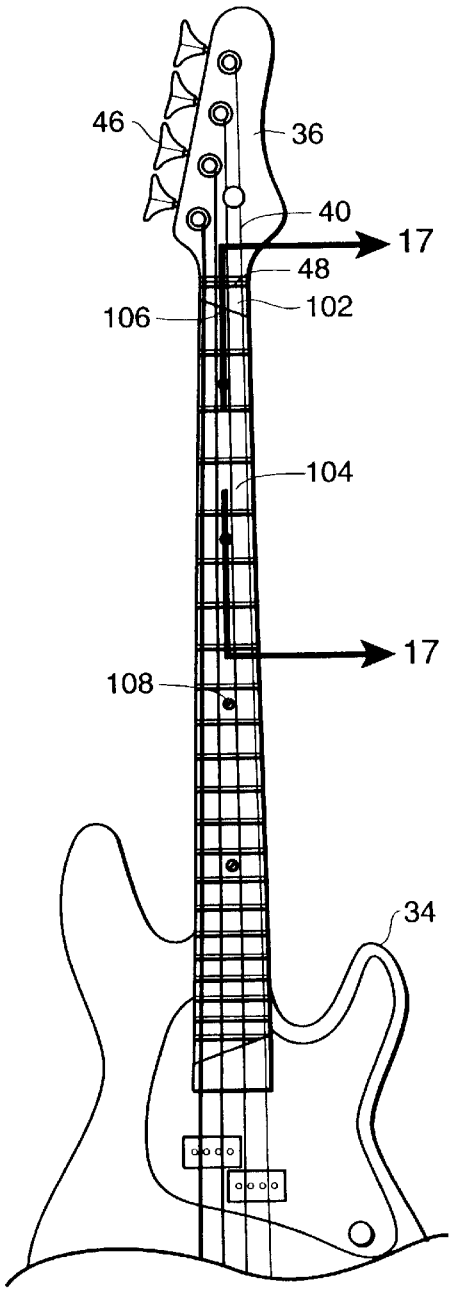
Figure 17:
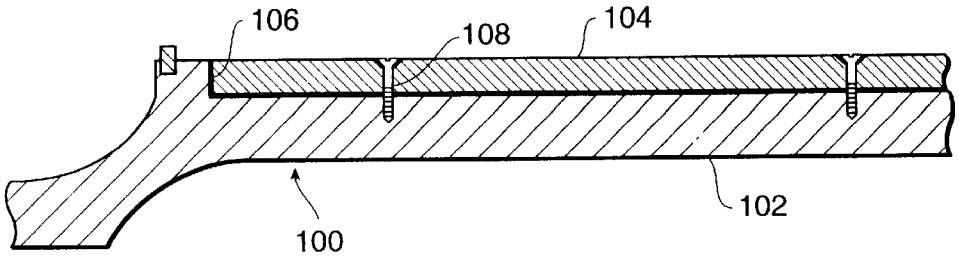
Figure 18:
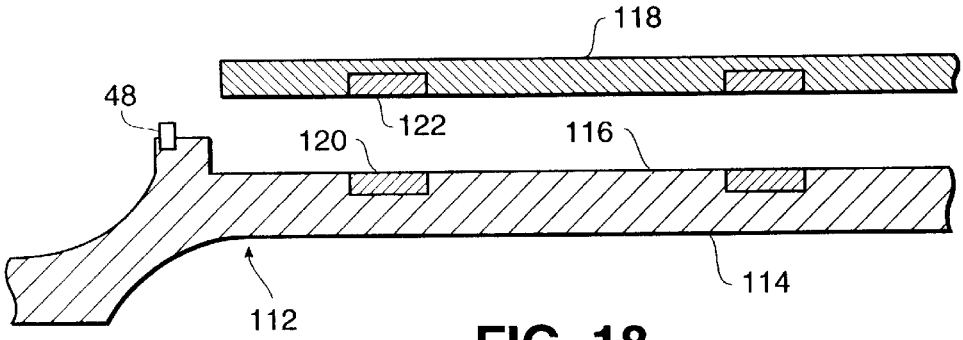
Figure 19:
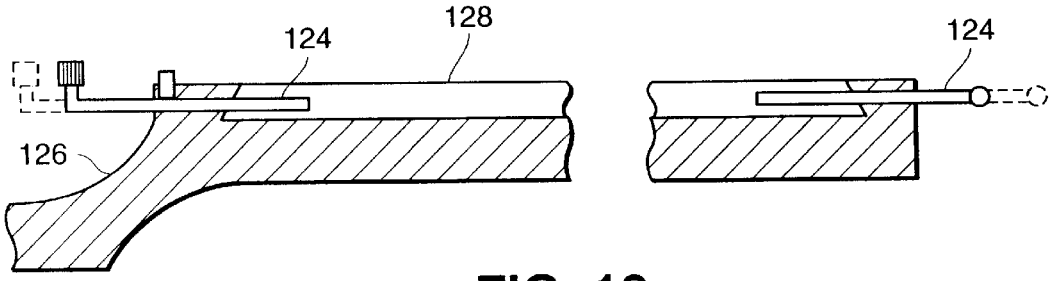
Figure 20:
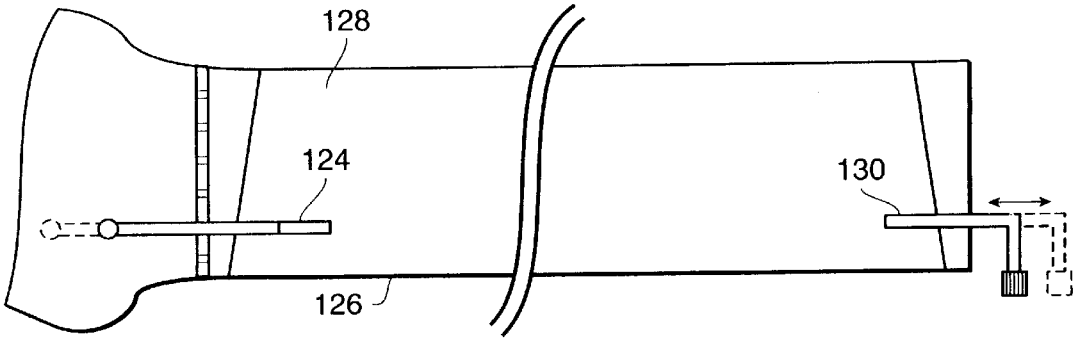

Having thus described the invention in general terms, reference will now be made to the accompanying drawings (six sheets) in which:

FIG. 1 is an exploded perspective view of a stringed musical instrument constructed in accordance with and embodying the present invention;

FIG. 2 is a fragmentary top plan view of the stringed musical instrument of FIG. 1 and showing a removable fingerboard in a position where it is being mounted on or removed from the neck of the musical instrument;

FIG. 3 is a fragmentary top plan view, similar to FIG. 2, and showing a fretted fingerboard mounted on the musical instrument in accordance with the present invention;

FIG. 4 is a fragmentary top plan view, similar to FIGS. 2 and 3, and showing a non-fretted fingerboard mounted on the neck of the musical instrument;

FIG. 5 is a fragmentary side elevational view of the head of the musical instrument showing the mounting of strings thereon;

FIG. 6 is at fragmentary top plan view of the musical instrument of the invention with a fingerboard removed therefrom and showing one means for mounting the fingerboard to the musical instrument;

FIG. 7 is a sectional view taken along line 6—6 of FIG. 6 and showing a reinforcing member extending through the neck of the musical instrument;

FIG. 8 is a vertical sectional view taken along line 8—8 of FIG. 6;

FIG. 9 is a bottom plan view of the underside of one form of fingerboard constructed in accordance with the present invention in order to show the mating relationship with the neck of the musical instrument of FIG. 7;

FIG. 10 is a fragmentary enlarged perspective view showing a detailed area of FIG. 9 and, particularly, the beveled grooves in the fingerboard to mount to the neck of the musical instrument;

FIG. 11 is an exploded fragmentary perspective view showing a double bevel groove construction for mounting a fingerboard to a neck of a musical instrument in a preferred embodiment of the present invention;

FIG. 12 is an exploded fragmentary perspective view showing the mounting of a fingerboard to the neck of the musical instrument using the mounting system of FIGS. 7–10;

FIG. 13 is a fragmentary sectional view, and showing a mounting of a fingerboard to the neck of a musical instrument employing a double bevel edge in a groove formed in the neck of the instrument;

FIG. 14 is a fragmentary exploded perspective view, showing a modified form of beveled edge in a groove for releasably receiving a fingerboard on the neck of a musical instrument;

FIG. 15 is a fragmentary exploded perspective view, and showing another modified form of double beveled edge for sliding a fingerboard into a groove on the neck of the musical instrument;

FIG. 16 is a fragmentary top plan view showing another modified form of mounting a fingerboard to the neck of a musical instrument using screws therefore;

FIG. 17 is a fragmentary sectional view taken along lines 17—17 of FIG. 16;

FIG. 18 is a exploded fragmentary sectional view showing a magnetic means for releasably mounting a fingerboard to the neck of a musical instrument in accordance with the present invention;

FIG. 19 is a fragmentary sectional view taken longitudinally through the musical instrument and showing a locking rod for securing the fingerboard to the musical instrument; and FIG. 20 is a fragmentary schematic top plan view showing the use of the locking rod for securing the fingerboard to the musical instrument.

DETAILED DESCRIPTION OF A PREFERRED EMBODIMENTS

Referring now in more detail and by reference characters to the drawings, which illustrate preferred embodiments of the present invention, reference numeral 30 represents a stringed musical instrument which has interchangeable fingerboards, as hereinafter described. For purposes of describing the present invention, a guitar has been illustrated in the drawings, although it should be understood that any of the stringed musical instruments of the type previously described could be constructed with the interchangeable fingerboard construction of the invention.

The musical instrument 30 generally comprises an elongate neck 32 having a body 34 at one end and head 36 at the opposite end. A plurality of wires, commonly referred to as "strings" 40 are secured to pins 42 on the head 36 and trained around guide posts 44 for extension over the neck of the musical instrument and the body 34. These strings 40 are tunable by means of tuning knobs 46 connected to the pins 42 in a conventional manner. At their opposite ends, the strings 40 are secured to the body of the musical instrument, also in a conventional fashion.

The actual construction of the head 36 and the components thereon, as well as the body 34, is conventional and therefore is neither illustrated nor described in any further detail herein. In this respect, the invention as described herein is equally applicable to both non-electrical string musical instruments and electrical versions of these musical instruments. Insofar as the present invention is concerned, either version would operate in the same way.

The strings 40 of the musical instrument are extended over and trained against a transversely extending protrusion 48 at the region of joinder of the neck 32 to the head 36 and which is typically referred to as a nut. In this respect, the strings 40 have been broken away or eliminated in some of the drawing figures, for purposes of clarity. At its right-hand end, that is, adjacent the body 34, the musical instrument is provided with another transverse upwardly extending projecting element 50 typically referred to as the "bridge".

By reference to FIGS. 1, 2 and 6, it can be seen that the neck 32 is provided on its upper surface with an elongate groove 52 having opposite edges 54 and 56 in proximity to the head 36 and in proximity to the body 34, respectively. The elongate groove extends for the greater portion of the length of the neck 32. Also, by reference to FIGS. 1, 7 and 11, it can be seen that the groove 52 reduces the overall thickness (in the vertical dimension) of the neck 32. Although this reduces bending moment strength, compensation is provided, as hereinafter described.

In the normal construction of stringed musical instruments, the neck is connected to the body with an extended end fitting into a pocket formed in the body. The neck can then be secured in that pocket by conventional fasteners, if desired. In another embodiment, a so-called through body neck is used. In this case, the neck extends all the way through the body of the musical instrument. In a third embodiment, the neck is attached to the body with a so-called "acoustic body attachment". In this case, a heel is provided on the body and the neck is secured to that heel and to the body. The present invention is operable with any of these neck-body constructions.

Mounted within the groove 52 is either a fingerboard 58 or a fingerboard 60. The fingerboard 58 is provided with a plurality of upstanding protrusions 62 or so-called "frets" extending transversely across the fingerboard, as shown in FIGS. 2 and 3. In this way, a player of the musical instrument can literally modify the length of the strings between the point where the musician engages the strings with the frets 52 and the bridge 50. The fingerboard 60 is provided with a relatively smooth upper surface, as shown in FIG. 4, and, therefore, constitutes a non-fretted fingerboard. Although only two such fingerboards have been illustrated, it should be understood that other types of fingerboards could also be substitutably mounted within the groove 52, if desired.

The fingerboards 58 and 60 are formed so that the longitudinal edges will be marginally aligned with the longitudinal edges of the groove 52. Moreover, the transverse ends are cut so that they will properly fit within the groove 52.

Various means for removably mounting the fingerboards to the neck 32 are hereinafter described. One of the preferred means for removably mounting the fingerboards is more fully illustrated in FIGS. 2–4, 6 and 8–13 of the drawings. This means relies upon a double bevel edge forming the groove, as hereinafter described in more detail.

The edges 54 and 56 of the groove 52 are each cut with a double bevel. Thus, by referring to FIGS. 1, 2, 5, 11 and 12, it can be seen that the left-hand edge 54 of the groove 52, adjacent the head 36, is under-cut to form a beveled edge which is progressively cut into the stock of the neck toward its lower end. Thus, the edge 54 tapers downwardly and outwardly to form a V-shaped notch 66. This notch 66 has a regular cross-section across its transverse dimension but one end is closer to the head 36 than the opposite transverse end. The opposite edge 56 is similarly provided with a V-shaped notch substantially similar to that shown at the edge 54, but being opposed to the notch at the edge 54.

The edge 54 is also beveled transversely across the board, thereby providing a double bevel. In this case, the V-shaped notch is angularly located with respect to a transverse axis 68 across the width of the neck. It can be seen that the V-shaped notch 66 angles away from a transverse axis. The notch, at the opposite edge of the groove 56 would similarly have a double bevel and would also be angularly displaced from a transverse axis 68, but in the opposite direction, such that in space, the two notches 66 would intersect.

By further reference to FIG. 12, it can be seen that the transverse edges of the fingerboards, e.g., the fingerboard 58, are also provided with double beveled edges to correspond to and mate with the edges 54 and 56, respectively. Thus, the left-hand edge of the fingerboard 58 is similarly tapered with a V-shaped projection 70 size to fit within the notch 66 at the edge 54. In like manner, the right-hand end of the fingerboard is provided with a somewhat V-shaped projection 72 to fit within the corresponding notch at the edge 56.

In accordance with the above-identified construction, it can be seen that the fingerboards can be slid into the elongate neck 32 from one longitudinal side of the neck and pushed toward the other longitudinal side thereof. As the fingerboard reaches the opposite longitudinal side of the groove 52, it will automatically come to a rested position where further transverse movement is stopped. At this point, the fingerboard will be marginally registered with the edges of the neck because of the precise cuts of the double beveled edges 54 and 56. Essentially, this is the only locking mechanism which is required for grooves having a short longitudinal extent.

For grooves having a longer longitudinal extent, such as in guitars and bases, it is usually desirable to provide intermediate locking elements 74 on the upper surface of the neck 32, as shown in FIGS. 1, 2, 6 and 11. These locking elements 74 (three as shown in the illustrated embodiment) each have double tapered edges 76 along one transverse side and which will mate with the double tapered edges forming the notches 66. These double tapered edges 76 similarly form notches 78.

The underside of the fingerboards are also provided with recesses having shapes corresponding to the upstanding locking elements 74, as best shown in FIG. 11 of the drawings. Thus, the fingerboards are each provided with generally transversely extending recesses 80 sized to receive the upstanding locking elements 74. In accordance with this construction, it can be seen that fingerboards with a greater length, such as those required for guitars and bases, can also be slidably mounted within the elongate groove on the neck of the musical instrument.

It has been found in connection with the present invention that the angle of the taper of the edges 70 and 72 on the fingerboards are preferably at about 45°. However, it has been found that this angle can range from about 32° to about 61°. Naturally, the corresponding angle of taper of each notch also would have an angle compatible with that of the angle of taper on the fingerboard edges. Thus, if the angle of taper is 40° for each of the edges of the fingerboard, then the corresponding angle of each of the notches should be 140°.

It has also been found in connection with the present invention that the fingerboards should also have the second taper from one transverse edge of the neck to the opposite transverse edge relative to a transverse center line at about 20°. However, here again, that angle can vary from about 13° to 32°.

By virtue of the above-identified construction, it can also be seen that the fingerboards are capable of being rapidly removed from the elongate grooves by merely sliding the same to one lateral side of the neck of the musical instrument. A new fingerboard can thereupon be introduced into the groove formed in the neck of the musical instrument. Moreover, since the longitudinal edges of the fingerboards will become automatically marginally aligned with the edges of the neck, essentially no alignment action is required on the part of the user. In addition, the fingerboards will be tightly, but nevertheless slidably, retained within the grooves by friction fit therein. However, if desired, additional means could be provided for locking the fingerboards in their mounted position within the elongate groove.

Although the double bevel edge formed in the groove 52 of the neck 32 has been found to be a very effective means for locking the fingerboards within the elongate groove, other locking systems which still afford a slidable shifting movement of the fingerboard into and out of the groove may also be provided. Two of such systems are more fully illustrated in FIGS. 14 and 15 of the drawings.

FIG. 14 illustrates an embodiment of the invention in which the elongate groove of the musical instrument has edges 82 provided with under-cuts forming notches 84. The edges of the fingerboards 86 are provided at their lower ends with transversely extending outwardly projecting tabs 88 which slidably fit within the notches 84. In this respect, the notches 84 and the tabs 88 can be rectangularly shaped in cross-section, they may be provided with a bevel or inclined face 89 across the transverse dimension of the fingerboards and the notch 84, such that the fingerboards will come to rest in a marginally registered and aligned position with the neck of the musical instrument.

FIG. 15 illustrates a slightly modified form of tab and notch system in which the edges of the groove in a neck 90 are provided with somewhat of an arcuately-shaped notch 92. In this case, a fingerboard 94 having an outwardly extending somewhat arcuately-shaped tongue 96 is sized to fit within the notch 92, in the manner as best shown in FIG. 15. Again, both the tongue 96 and the notch 92 could be beveled from one longitudinal side of the neck toward the opposite longitudinal side in order to enable precise marginal registration of the fingerboard with the neck when the fingerboard has been shifted to its end position in the groove.

It should be understood that the constructions illustrated in FIGS. 14–16 are only a few of the various types of constructions which can be used for slidably mounting a fingerboard in the groove formed in the neck of a musical instrument. Any of these mechanisms are efficient, in that they allow the fingerboard to be slidably mounted from one side of the musical instrument into a precise position where the edges of the fingerboard become marginally registered with the longitudinal edges of the neck.

Other means for securing the fingerboard to the neck of the musical instrument can also be provided, as indicated above. As a simple example, only a single bevel can be employed on each of the edges of the grooves and a single matching bevel would be used on the transverse edges of the fingerboard. In this case, additional stops, such as upstanding tabs, would be provided to limit the transverse movement of the fingerboard as it is inserted into a fixed position on the neck of the musical instrument. one means which avoids the need for precisely cut edge portions at the edges of the groove, are shown in FIGS. 16 and 17. In this case, a musical instrument 100 having an elongate neck 102 is provided with a removable fingerboard 104 having relatively flat transverse edges 106, as best shown in FIGS. 16 and 17. In this case, the fingerboard 104 is removably secured to the upper surface of the neck 102 by means of screws 108 which extend through the fingerboard 104 and into the neck 102. Moreover, and in the embodiment as illustrated, it can be seen that the heads of the screws are counter-sunk into the surface of the fingerboard 104.

In order to remove the fingerboard, it is necessary to remove the screws 108 and merely lift the fingerboard out of the recess formed in the neck of the musical instrument. In like manner, remounting of the fingerboard merely requires the insertion of the fingerboard into the recess and securement of same with the screws 108. Other forms of mechanical fasteners could also be used for this purpose.

FIG. 18 illustrates an embodiment of a musical instrument 112 having a neck 114 with a groove 116 formed therein to receive a removable fingerboard 118. In this embodiment, the neck is provided on its upper surface with magnets 120, and in like manner, the fingerboard is provided on its undersurface with magnets 122 generally in alignment with the magnets 120. In this way, in order to insert a fingerboard into the groove 116, it is only necessary to merely drop the fingerboard in the groove 116 and the magnets 120 and 122 will automatically couple providing removable locking action. Naturally, additional locking actions can be provided, if desired.

FIGS. 19 and 20 illustrate an embodiment in which a locking pin 124 can be inserted in the region of joinder of the neck to the head of the musical instrument, that is, the region identified as 126 in FIGS. 19 and 20. The pin 124 also extends longitudinally into the body of a fingerboard 128, as best shown in FIGS. 19 and 20. The pin 124 is designed for locking movement when pushed from the position as shown in the dotted lines of FIG. 19 to the position as shown in the solid lines of FIG. 19. When the pin is pulled to the rear, that is, to the dotted lines of FIG. 19, the fingerboard 128 can then be raised from its position on the neck of the musical instrument. By further reference to FIG. 19, it can be seen that the pin 124 extends beyond the opposite end of the musical instrument. Further, in FIG. 20, it can be seen that when the pin 124 is turned, an angularly projecting tab 130 on the pin 124 will be turned to lie in a locked position, as shown in FIG. 20.

It may be appreciated that the neck of the musical instrument may suffer reduced ability to withstand bending moment forces imposed on the neck because of the removal of material in that region. This is particularly the case, since the neck of the musical instrument in actual use is frequently subjected to bending moment forces. In addition, string tension will tend to create deformation of the neck.

In order to compensate for the reduced thickness of the neck, at least in the region of the groove, an elongate longitudinally extending reinforcing truss 140 is inserted into the neck and portions of the head and body, as shown in FIGS. 6–8. The truss 140 in the embodiment as illustrated is T-shaped with a vertically arranged flange 142 and a horizontally arranged flange 144, the latter having its upper surface flush with the bottom of the groove formed in the neck of the musical instrument. The truss 140 itself is preferably formed of a strong structural material, such as steel or the like. The truss could be formed of other materials of construction, such as reinforced plastics, etc.

It is also possible to insert a tensioning rod 146 through the truss 144. The tensioning rod 146 also adds additional reinforcement and preferably extends from one end of the musical instrument to the other. Moreover, the tensioning rod 146 would have one or both ends external to the musical instrument. In this way, by turning nuts on the tensioning rod, the opposite ends of the instrument are effectively compressed and tension is provided on the instrument itself.

Although the truss 140 is T-shaped in the embodiment as illustrated, this truss could also adopt other beam shapes as, for example, an I-beam construction or the like. In some cases, if the neck of the musical instrument is formed of a reinforced plastic composite material, a longitudinal truss is not required. However, in most preferred constructions, the material of the neck is wood. If the truss is constructed of a hard wood, the truss can be laminated to the neck. However, the truss is preferably a metal, such as steel, aluminum, or the like. The truss itself may be a molded carbon fiber type reinforced plastic composite material. It is important, however, in connection with the present invention to insure that the truss is light weight. For this purpose, light weight metals, such as aluminum or magnesium are preferred.

Thus, there has been illustrated and described a unique and novel musical instrument of the type having a removable and substitutable fingerboard assembly. The present invention therefore fulfills all of the objects and advantages which have been sought. It should be understood that many changes, modifications, variations and other uses and applications will become apparent to those skilled in the art after considering the specification and the accompanying drawings. Therefore, any and all such changes, modifications, variations and other uses and applications which do not depart from the spirit and the scope of the invention are deemed to be covered by the invention.

Having thus described the invention, what I desire to claim and secure by letters patent is:

1. A stringed musical instrument capable of having a fingerboard rapidly removable from and remounted on a neck of the instrument, said musical instrument comprising:

a) a neck;

b) means forming a fingerboard retaining groove in said neck and which is beveled; a fingerboard slidable into said groove extending across said neck and which is slidable out of said groove for removing same;

c) strings extending across and along said neck and said fingerboard;

d) a sound generating member connected to said neck and causing generation of musical sounds in response to vibration of said strings and in response to a selected engagement of the strings with the fingerboard; and e) means for retaining said fingerboard on said neck in such manner that the fingerboard can be rapidly disconnected from and remounted on said neck without manually manipulatable mechanical fasteners.

2. The stringed musical instrument of claim 1 further characterized in that means is associated with said groove to limit sliding movement of the fingerboard when inserted into said groove so that said fingerboard is in a proper position on the neck when it has reached its limit of movement.

3. The stringed musical instrument of claim 1 further characterized in that said groove has edges which are double beveled edges.

4. In a stringed musical instrument of the type having a neck with strings extending across said neck, and a sound generating chamber generating sounds responsive to vibration of said strings and the sounds also being responsive to engagement of the strings in selected positions with respect to a fingerboard on said neck, an improvement comprising:

a) a first fingerboard removably mounted on said neck and having frets thereon which are selectively engagable by said strings allowing for a first group of musical sounds to be generated when said strings are physically engaged in contact with said frets on said first fingerboard and vibrated; and b) a second fingerboard removably mounted on said neck in place of said first fingerboard and having no frets thereon such that the strings are physically engaged in contact directly with a surface of the second fingerboard allowing for a second group of sounds to be generated when said strings are engaged with said fingerboard and vibrated thereby allowing the same stringed musical instrument to become a fretted and a non-fretted instrument.

5. In a stringed musical instrument of claim 4, the improvement further characterized in that each of said first and second fingerboards are retained on said neck in such manner that the fingerboard can be readily removably mounted on said neck and remounted without need for manually manipulatable mechanical fasteners.

6. In a stringed musical instrument of claim 5, the improvement further characterized in that each said fingerboard is slidable into an elongate retaining recess in said neck and extending lengthwise of said neck, and out of said recess to remove same from said neck.

7. In a stringed musical instrument of claim 6, the improvement further characterized in that means is associated with said recess to limit sliding movement of the fingerboard when inserted into said recess so that said fingerboard is in a proper position on the neck when it has reached its limit of movement.

8. In a stringed musical instrument of claim 4, the improvement further characterized in that said fingerboards are removably mounted on said neck by magnetic means.

9. In a stringed musical instrument of claim 4, the improvement further characterized in that said fingerboards are each mounted on said neck by screw means.

10. In a stringed musical instrument of claim 4, the improvement further characterized in that each of said fingerboards is retained on said neck by a removable locking pin.

11. A stringed musical instrument having an elongate neck with a large aspect ratio and which is reinforced over its length, said musical instrument comprising:

a) said elongate neck comprising a first end and a second end and also having a base section and a removable top plate, and having an elongate extent;

b) a resonant body at said first end of said elongate neck and being relatively permanently secured thereto and enabling the generation of sounds when strings extending thereacross are vibrated;

c) a head at said second end of said neck and being relatively permanently secured thereto and mounting ends of said strings; and d) an elongate reinforcing member extending through said neck to provide added reinforcement beyond that in which the neck is secured to the body and the head and thereby reinforce said neck against cracking when subjected to a bending movement when said top plate is removed.

12. The strings musical instrument of claim 11 further characterized in that said reinforcing member also extends into said body and said head and is fixedly retained in each said body and head.

13. The stringed musical instrument of claim 11 further characterized in that said reinforcing member is of T-shaped cross-section.

14. The stringed musical instrument of claim 11 further characterized in that said neck has a base section and a top plate on said base section which is removable therefrom.

15. The stringed musical instrument of claim 14 further characterized in that said neck has an elongate groove reducing the thickness of said neck and which groove receives the removable top plate.

16. A stringed musical instrument having the capability of substituting one fingerboard for another rapidly and without need for manually manipulatable mechanical fasteners, said musical instrument comprising:

a) an elongate neck;

b) a body having a resonant cavity at one end of said neck;

c) a plurality of strings extending across said neck and said body and generating musical sounds in response to vibration of said strings;

d) a groove formed in said neck of said musical instrument and having opposite edges with an under-cut bevel, such that each of the opposite ends of the grooves are under-cut into the neck of the fingerboard at the ends of the groove; and e) a fingerboard having transversely extending tapered ends sized to fit within the beveled under-cut at the ends of the groove, such that the fingerboard can slide into the groove from one longitudinal side of the neck to the opposite longitudinal side thereof.

17. The stringed musical instrument of claim 16 further characterized in that the edges of said groove are provided with a double bevel, such that the edges of the groove are also angularly located relative to a transverse dimension of the neck of the musical instrument and the tapered edges of the fingerboard are similarly cut at an angle substantially the same as that of the edges of the groove.

18. A method of converting a stringed musical instrument of the type having an elongate neck and resonant body from one which has frets to one which is fretless and vice-a-versa, said method comprising:

a) locating a fretted fingerboard onto the neck of the musical instrument;

b) securing the fretted fingerboard in a fixed position on the neck of the musical instrument for the play of music;

c) removing the fretted fingerboard from the fixed position on the musical instrument; and d) locating a non-fretted fingerboard in place of the fretted fingerboard in accordance with step (a) on the neck of the musical instrument.

19. The method of claim 18 further characterized in that said method comprises slidably inserting said fingerboard into a recess having bevels at the edges of the recess.

20. A stringed musical instrument having the capability of substituting one fingerboard for another rapidly and without need for manual manipulatable mechanical fasteners, said musical instrument comprising:

a) an elongate neck;

b) a body having a resonant cavity at one end of said neck;

c) a plurality of strings extending across said neck and said body and generating musical sounds in response to vibration of said strings;

d) fingerboard receiving means on said neck of said musical instrument to receive the fingerboard and having at least one transverse end with a beveled under-cut, such that such end of the fingerboard receiving means is under-cut into the neck of the fingerboard instrument at this end of the fingerboard receiving means; and e) a fingerboard having a transversely extending tapered ends sized to fit within the beveled under-cut at the corresponding end of the fingerboard receiving means, such that the fingerboard can slide into the fingerboard receiving means from one longitudinal side of the neck to the opposite longitudinal side thereof.

21. The stringed musical instrument of claim 14 further characterized in that said reinforcing member is formed of a reinforced plastic composite material.

22. The stringed musical instrument of claim 21 further characterized in that said fingerboard receiving means has opposite transverse ends and each having a beveled under-cut, and that said fingerboard has transversely extending opposite tapered ends sized to fit within the under-cut at corresponding transverse ends of said fingerboard receiving means.

23. The stringed musical instrument of claim 21 further characterized in that at least one intermediate locking element is located in said fingerboard receiving means and is adapted to interlockably mate with a corresponding locking element on said fingerboard, such that said fingerboard can be slid onto said fingerboard receiving means from only one transverse side of said fingerboard.

24. The method of converting the stringed musical instrument of claim 23 further characterized in that one of said intermediate locking elements and sad corresponding locking element project outwardly from a surface of either the neck of the fingerboard, and the other of the corresponding locking element or intermediate locking element comprises a notch formed in the other of the opposed surface of the neck or the fingerboard and which projecting element slides into said notch from one transverse side of said neck.

25. The method of converting the stringed musical instrument of claim 24 further characterized in that said intermediate locking element is an upstanding element projecting upwardly from a surface of the neck having the fingerboard receiving means and said corresponding locking element is a notch formed in the underside of the neck.

26. The stringed musical instrument of claim 24 further characterized in that said projecting element has a beveled edge which matches and locks with a corresponding beveled edge on said notch, such that the fingerboard cannot be lifted directly off of the surface of the neck without a transverse sliding action.

27. The stringed musical instrument of claim 24 further characterized in that said projecting element has a beveled outwardly and upwardly flaring edge which matches and locks with a corresponding downwardly and outwardly flaring beveled edge on said notch, such that the fingerboard cannot be lifted off of the surface of the neck without a transverse sliding action.

28. The stringed musical instrument of claim 26 further characterized in that said projecting element has one flat horizontally disposed surface which matches an opposite horizontally disposed surface of said notch.

29. The method of converting the stringed musical instrument of claim 26 further characterized in that the beveled edges are each double beveled edges which extend across said fingerboard and neck at an acute angle relative to a transverse dimension of said neck and fingerboard.

30. The method of converting the stringed musical instrument of claim 26 further characterized in that the beveled edges are each beveled edges which extend across the fingerboard and neck perpendicularly to the longitudinal axis of the neck and fingerboard.

31. In a stringed musical instrument of the type having a neck with strings extending across said neck, and a sound generating chamber generating sounds responsive to vibration of said strings and the sounds also being responsive to engagement of the strings in selected positions with a fingerboard on said neck, an improvement comprising:

a) a first fingerboard removably mounted on said neck and allowing for a first group of musical sounds to be generated when said strings are engaged with said first fingerboard and vibrated;

b) a second fingerboard removably mounted on said neck in place of said first fingerboard and allowing for a second group of sounds to be generated when said strings are engaged with said fingerboard and vibrated; and c) screw means for removably mounting said first and second fingerboards on said neck.

32. In a stringed musical instrument of claim 31, the improvement further characterized in that said first fingerboard is a fretted fingerboard and said second fingerboard is a non-fretted fingerboard.

33. In a stringed musical instrument of the type having a neck with strings extending across said neck, and a sound generating chamber generating sounds responsive to vibration of said strings and the sounds also being responsive to engagement of the strings in selected positions with a fingerboard on said neck, an improvement comprising:

a) a first fingerboard removably mounted on said neck and allowing for a first group of musical sounds to be generated when said strings are engaged with said first fingerboard and vibrated;

b) a second fingerboard removably mounted on said neck in place of said first fingerboard and allowing for a second group of sounds to be generated when said strings are engaged with said fingerboard and vibrated; and c) a removable locking pin for mounting each of said first and second fingerboards to said neck.

34. A stringed musical instrument having the capability of substituting one fingerboard for another rapidly and without need for manually manipulatable mechanical fasteners, said musical instrument comprising:

a) an elongate neck;

b) a body having a resonant cavity at one end of said neck;

c) a plurality of strings extending across said neck and said body and generating musical sounds in response to vibration of said strings;

d) a fingerboard receiving area on said neck of said musical instrument and having at least one transverse end;

e) a fingerboard having a size and shape to fit on the fingerboard receiving area and having at least one end engaging the corresponding end of the fingerboard receiving area f) a pair of end locking elements for releasably locking the fingerboard to the neck of the musical instrument with a first locking action;

g) at least one upstanding intermediate locking element located on said fingerboard receiving area and having a transversely extending beveled edge which is adapted to interlockably mate with a corresponding locking element on said fingerboard providing a second locking action which is different from said first locking action, such that said fingerboard can be slid onto said fingerboard receiving area from only one longitudinal side of said fingerboard and lockably retained therein.

35. A stringed musical instrument of claim 34 further characterized in that said projecting element has a beveled edge which matches and locks with a corresponding beveled edge on said notch, such that the fingerboard cannot be lifted directly off of the surface of the neck without a transverse sliding action.

36. A stringed musical instrument of claim 35 further characterized in that said projecting element has one flat horizontally disposed surface which matches an opposite horizontally disposed surface of the neck.

37. The stringed musical instrument of claim 35 further characterized in that the fingerboard receiving area has opposite transverse end locking elements which are also provided with a bevel, such that the end locking elements have beveled edges which mate with beveled edges in corresponding notches on the fingerboard.

* * * * *